US006116067A

United States Patent [19]

Myers et al.

[11] Patent Number: 6,116,067

[45] Date of Patent: Sep. 12, 2000

[54] ELECTRONICALLY CONTROLLED LOCK SYSTEM FOR TOOL CONTAINERS

[75] Inventors: Gary L. Myers, Monee; Paul D. Caplinger, Tinley Park; William D. Denison, Palos Hills; Calin V. Roatis, Des Plaines, all of Ill.

[73] Assignee: Fort Lock Corporation, River Grove, Ill.

[21] Appl. No.: 09/190,686

[22] Filed: Nov. 12, 1998

Related U.S. Application Data

[60] Provisional application No. 60/065,210, Nov. 12, 1997.

[51] Int. Cl.[7] ..... E05B 47/00

[52] U.S. Cl. ..... 70/279.1; 70/278.7; 70/278.6; 70/78; 292/341.16; 292/DIG. 25

[58] Field of Search ..... 70/279.1, 278.7, 70/278.6, 280, 281, 282, 432, 78, 81, 79, 80; 292/144, 341.16, 341.15, DIG. 25, 300, 302; 312/217, 218, 219

[56] References Cited

U.S. PATENT DOCUMENTS

| | | | |
|---|---|---|---|
| 1,730,909 | 10/1929 | Anderson et al. | 312/217 |
| 4,302,039 | 11/1981 | Dukel et al. | 292/341.16 |
| 4,842,313 | 6/1989 | Boyko et al. | 292/341.16 |
| 5,199,288 | 4/1993 | Merilainen et al. | 70/279 |
| 5,257,860 | 11/1993 | Slivon | 312/218 |
| 5,392,025 | 2/1995 | Figh et al. | 340/545 |
| 5,575,515 | 11/1996 | Iwamoto et al. | 292/341.17 |
| 5,820,234 | 10/1998 | Capwell et al. | 312/216 |

*Primary Examiner*—Flemming Saether
*Assistant Examiner*—John B. Walsh
*Attorney, Agent, or Firm*—Banner & Witcoff, Ltd.

[57] ABSTRACT

A lock system for a tool container provides the convenience of remote control without compromising the simplicity of the manual key operation. The lock system has an electronically controlled actuating mechanism coupled to the locking mechanism for locking and unlocking the tool container. The coupling between the electronically controlled actuating mechanism and the locking system allows a user to manually override the electronically controlled actuating mechanism with the conventional key-turning operation.

10 Claims, 11 Drawing Sheets

ELECTRONICALLY CONTROLLED LOCK SYSTEM FOR TOOL CONTAINERS

RELATED APPLICATION(S)

This application claims the priority benefit of provisional application Ser. No. 60/065,210, filed on Nov. 12, 1997 and entitled "ELECTRONICALLY CONTROLLED LOCK SYSTEM FOR TOOL CONTAINERS."

FIELD OF THE INVENTION

This invention relates generally to lock systems, and more particularly to an electronically controlled lock system for tool containers or the like.

BACKGROUND OF THE INVENTION

Tool chests and cabinets on shop floors are often equipped with locks to protect the valuable tools or things stored therein. Such lockable tool containers are typically provided with a mechanical lock which is manually operated by the turning of a conventional key.

It has been proposed to add remote-controlled locking and unlocking capability to a tool container. The remote control feature potentially can provide significant convenience to the user. By actuating a button on a remote control unit, the user can unlock or lock a tool cabinet across the shop floor, without having to walk over to the tool cabinet to manually turn the key.

Although the convenience provided by the remote control feature is desirable, it is, however, not a simple matter to implement the remote control mechanism. The difficulty is in coordinating the manual key operation with the electronically controlled operation so that no undesirable interference between the two will occur. If the electronically controlled locking mechanism is not well integrated with the manual locking mechanism, the lock system will be cumbersome to use. The operational inconvenience caused by the lack of coordination between the manual and electronically controlled operations may actually outweigh the potential convenience provided by the remote control feature.

SUMMARY OF THE INVENTION

In view of the foregoing, it is a primary object of the invention to provide an electronically controlled locking mechanism for a tool container or the like that is effectively integrated with the conventional key-operated locking mechanism to provide the convenience of electronic control without compromising the simplicity of the locking operation.

It is a resultant object to provide an electronically controlled actuating mechanism coupled to the existing locking mechanism of a tool container that does not hinder the operation of the manual key operation.

It is an object of the invention to provide a lock system for a tool container that supports both manual key operation and electronic control and allows the manual key operation to override the electronically controlled operation without requiring the user to pay attention to the operational status of the electronic control.

It is another object of the invention to provide a lock system for a tool container which effectively integrates manual key operation with electronic control in a structure that is relatively simple to manufacture and convenient to install.

In accordance with these and other objects of the invention, this invention provides a lock system for a tool container, such as a tool chest or a tool cabinet, that provides the convenience of electronically controlled locking/unlocking operation while retaining the simplicity of the conventional key operation. The lock system has an electronically controlled actuating mechanism coupled to the exiting manual locking mechanism for locking and unlocking the tool container. The electronically controlled actuating mechanism has a microprocessor-based control circuit which controls the locking and unlocking operation in response to a control signal. The coupling between the electronically controlled actuating mechanism and the locking mechanism is detachable such that it can be overridden by the manual key operation.

In a first embodiment, the manual locking mechanism includes a vertical lock bar on a vertically slidable carrier. The electronically controlled actuating mechanism includes a cam disk driven by a motor under the control of the microprocessor. The cam disk is coupled to the lock arm via the engagement of a coupling pin on the cam disk and a spring-loaded, pivotally mounted, pall on the carrier. The pall can be disengaged from the coupling pin by manually lifting the lock bar and therewith the pall by the turning of a key, thereby overriding the electronically controlled operation.

In a second embodiment, the manual locking mechanism includes a horizontally movable actuating member. The electrical actuating means includes a motor-driven cam disk. A link arm, which has an elongated slot fitting over a coupling pin on the cam disk, couples the cam disk to the actuating member. The rotation of the cam disk causes the link arm to move the actuating member, which in turn moves two locking bars to lock or unlock the container. The slot on the link arm allows relative movement between the link arm and the coupling pin when the cam disk is in either the locking or unlocking position, thereby allowing the locking bars to be manually moved by the turning of a key to override the electronically controlled operation.

Other objects and advantages will become apparent with reference to the following detailed description when taken in conjunction with the drawings in which:

Figure 1:
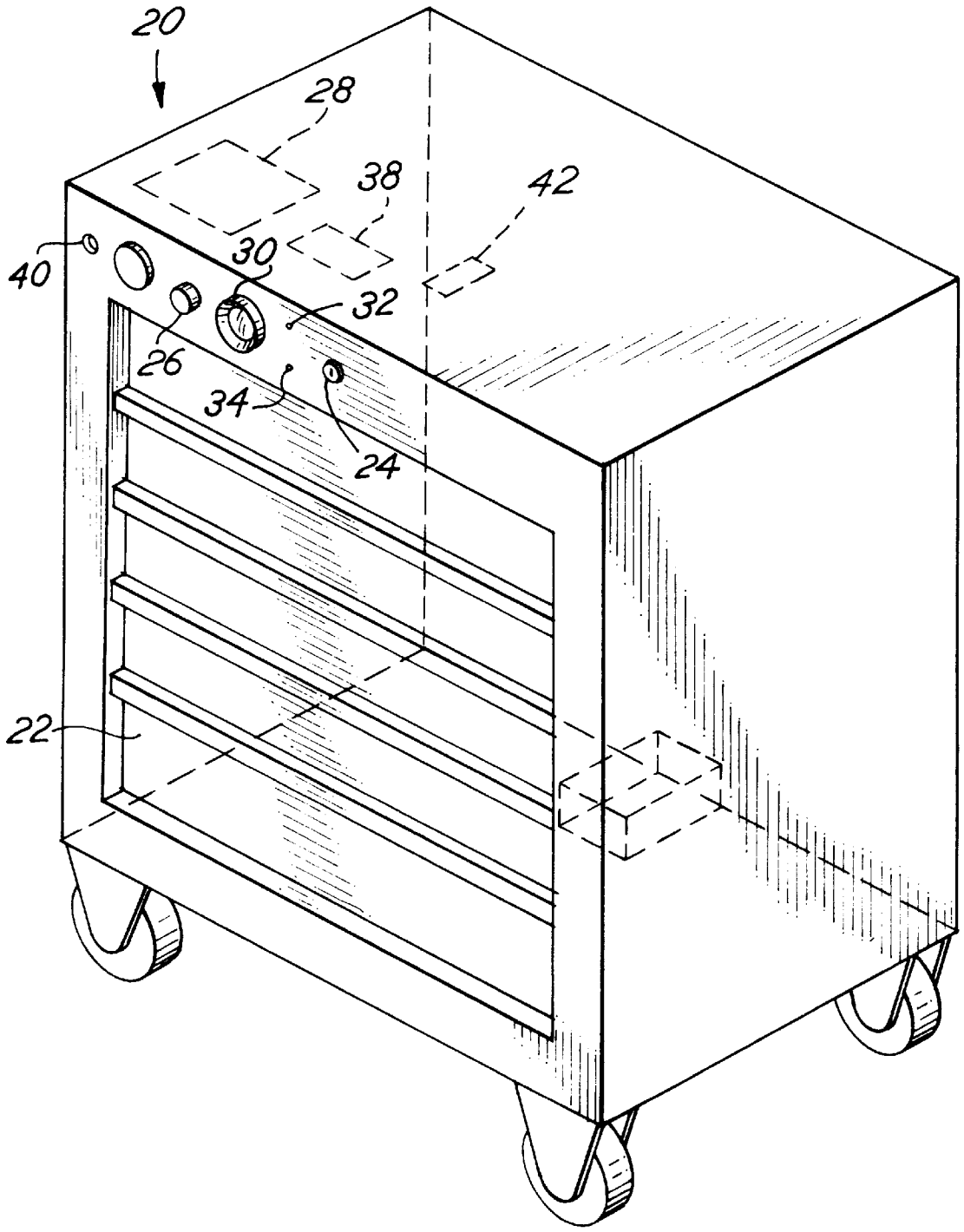
FIG. 1 is a perspective view of a tool cabinet which has a remote-control lock system constructed according to the invention.

While the invention is susceptible of various modifications and alternative constructions, certain illustrated embodiments hereof have been shown in the drawings and will be described below. It should be understood, however, that there is no intention to limit the invention to the specific forms disclosed, but, on the contrary, the invention is to cover all modifications, alternative constructions and equivalents falling within the spirit and scope of the invention.

DETAILED DESCRIPTION OF THE PREFERRED EMBODIMENT

Turning now to the drawings, FIG. 1 shows a tool cabinet 20 which has a lock system constructed according to the invention. The tool cabinet has a generally conventional construction, with a rectangular shape and a plurality of drawers 22 for tool storage. The tool drawers 22 can be pulled out horizontally from their closed positions shown in FIG. 1 when the tool cabinet is unlocked. As is conventional for tool containers, the tool cabinet of FIG. 1 has a keyhole 24 on its front surface. The tool cabinet can be manually locked and unlocked by inserting a key into the keyhole and turning the key to a locking or unlocking position. When the tool cabinet is locked, the drawers cannot be pulled out.

In accordance with the invention, the tool cabinet 20 is equipped with an electronically controlled locking mechanism which allows the user to lock or unlock the cabinet by transmitting an electronic control signal. The electronic control signal may be transmitted via direct electrical contact or be transmitted remotely. In the illustrated embodiment, the tool cabinet 20 is configured to receive control signals in both forms of transmission. As shown in FIG. 1, the tool cabinet has an electronic key receptacle 26 for receiving an electronic key, which upon forming contact with the receptacle communicates with a microprocessor on a control board 28 in the cabinet to lock or unlock the cabinet. The tool cabinet 20 also has an infrared receiver positioned behind an infrared-transmissive window 30 with a focusing lens for receiving infrared control signals transmitted from a remote control unit (not shown). It will be appreciated by those skilled in the art that the remote control can also be implemented by transmitting and receiving control signals in the radio frequency (RF) range without deviating from the spirit and scope of the invention.

The tool cabinet 20 is further provided with means for indicating the status of the lock system and for providing warning signals. In the illustrated embodiment, the indicating means includes a green LED 32, a red LED 34, and a piezoelectric siren 36 for generating audio signals.

To prevent tampering, the tool cabinet is powered by a self-contained power source, which in the illustrated embodiment is a 6 volt lead acid battery 38 of a suitable size. The battery 38 powers the control circuit on the control board 28 and also powers one or more electrical actuating means, such as motors, for actuating the locking mechanism. A fuse is provided on the battery for short prevention. Electrical power for recharging the battery is connected to the battery through a power port 40 on the front surface of the cabinet. An optional on-off switch 42, which is also installed inside the cabinet, is used to cut off the supply of the battery power to the control system during shipment of the tool cabinet.

Figure 2:
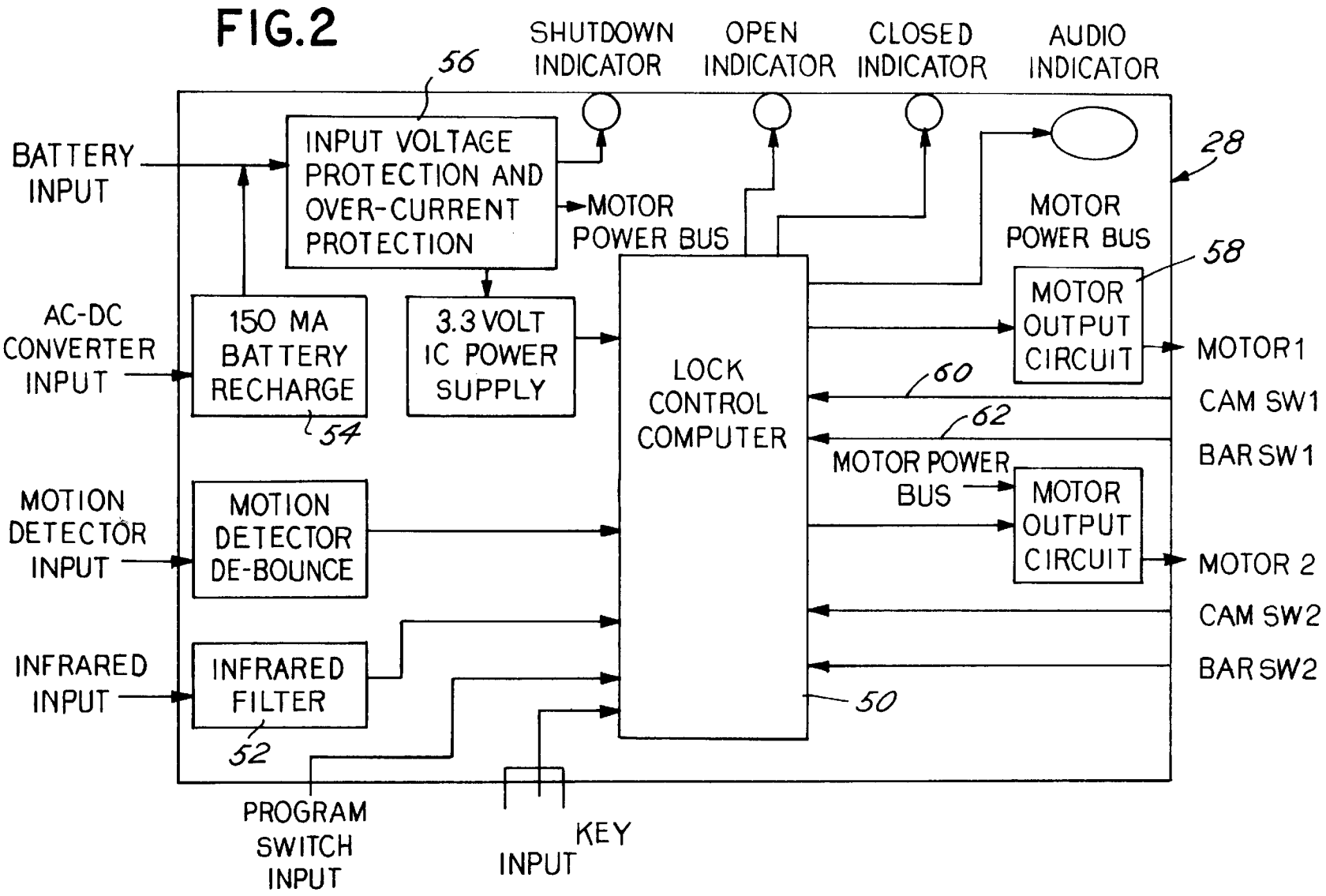
FIG. 2 is a functional block diagram showing the functions of a control board in the tool cabinet.

The control circuitry mounted on the control board 28 for the electronically controlled lock system is shown in FIG. 2 in a functional block form. The heart of the control circuitry is a microprocessor 50. Many different microprocessors can be used to implement the control functions. In the preferred embodiment the microprocessor 50 is a Motorola 68011. Infrared control signals from a remote control unit is passed via an infrared filter 52 to the microprocessor. Control signals received from an electronic key via the electronic key receptacle is likewise transmitted to the microprocessor. Electrical power received from the power port is connected to a battery recharge circuit 54 which provides charge current up to 150 mA to the battery. The electrical power from the battery goes through a protection module 56 which provides input voltage protection and over current protection. The output of the protection module 56 is connected via a motor power bus to motor control circuit circuits 58, each of which is controlled by the microprocessor to turn on or off the current supply to a motor 66. In the illustrated embodiment, two motor control circuits 58 are shown. It will be appreciated that more motor control circuits may be connected to the microprocessor, depending on the number of motors required for the specific configuration of the tool container. For each motor controlled by the microprocessor, there is an input 60 for a cam position signal and an input 62 for a lock bar position signal, the functions of which will be described in greater detail below.

The microprocessor 50 controls the operation of indicators for indicating the open or close state of the tool cabinet. As described above, the indicators of illustrated embodiment include the green LED and the red LED on the front surface of the tool cabinet, and a siren for generating audio signals. The lock system may also include a motion detector, such as an accelerometer, for detecting movement of the tool cabinet.

Figure 3:
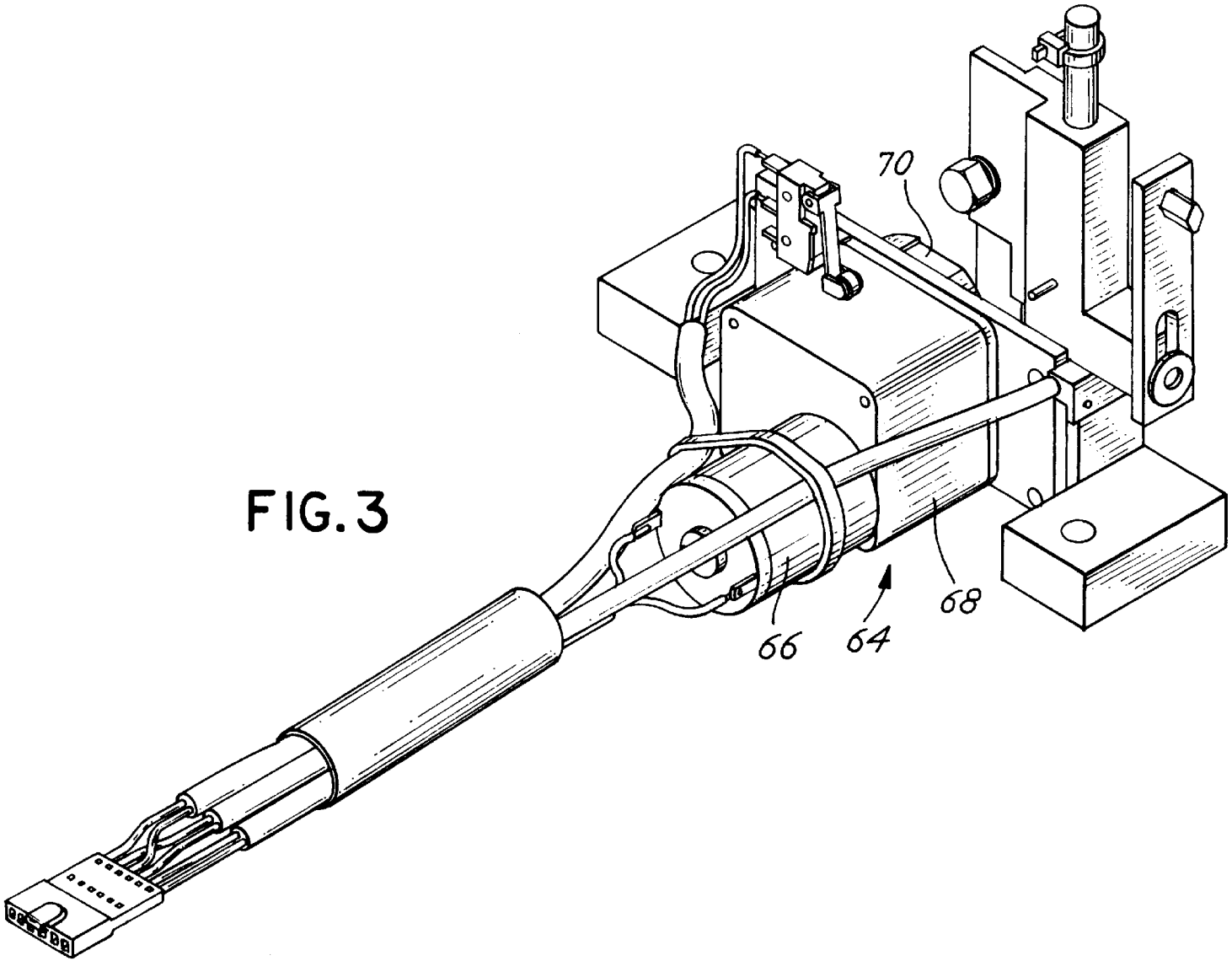
FIG. 3 is a motor and gear combination usable for implementing an electronically controlled lock system of the invention.

FIG. 3 shows a motor and gearbox assembly 64 which may be used in the lock system for actuating the locking mechanism. The motor 66 is a permanent-magnet DC motor, the motion of which is controlled by a motor control circuit 58 on the control board 28. The motor 66 is coupled to a parallel-shaft gear reduction box 68 to provide more accurate control of the rotation of a cam disk 70 which will be described in greater detail below.

Figure 4:
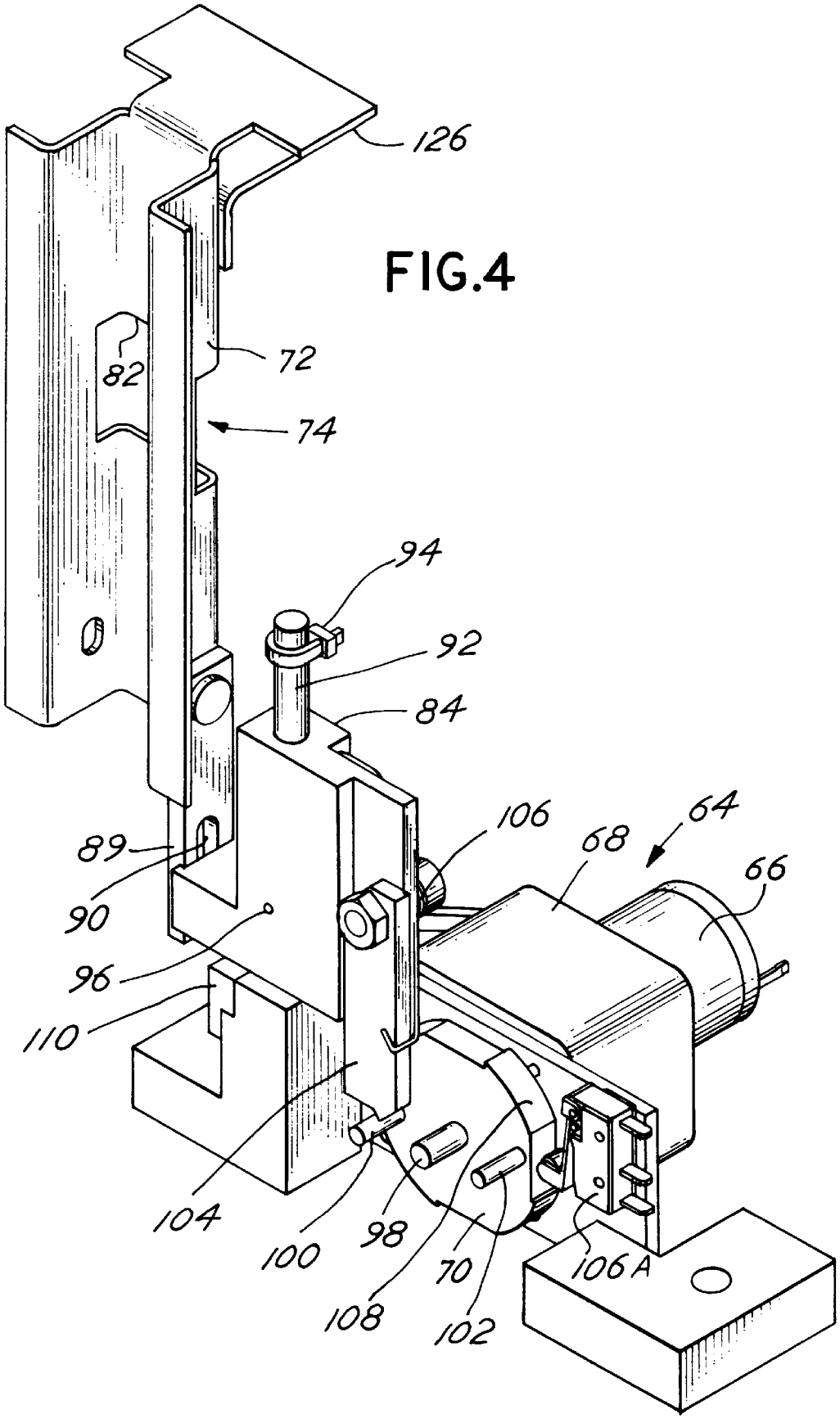
FIG. 4 is a perspective view of a lock system which has a vertically slidable lock bar.

Turning now to FIG. 4, in the present embodiment, the locking mechanism includes a vertically movable lock bar 72 which has a generally U-shaped cross section with two side flanges. The lock bar is guided for vertical sliding movement in a guide rail (not shown) secured on the inner side of the back panel of the tool cabinet. The lock bar 72 is shown to have a locking aperture 74 for locking a drawer in position. For simplicity of illustration, only one locking aperture is shown. It will be appreciated, however, that the lock bar may have a plurality of locking apertures corresponding to the number of drawers in the tool cabinet.

Figure 5:
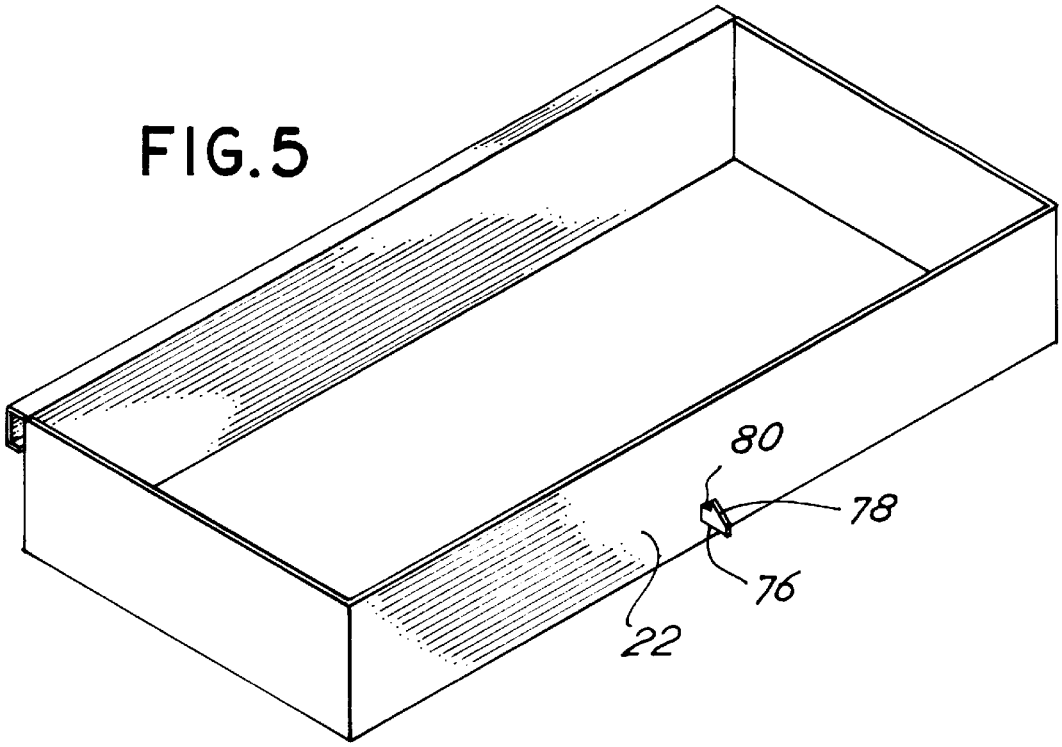
FIG. 5 is a perspective view of a drawer of the tool cabinet.
Figure 6:
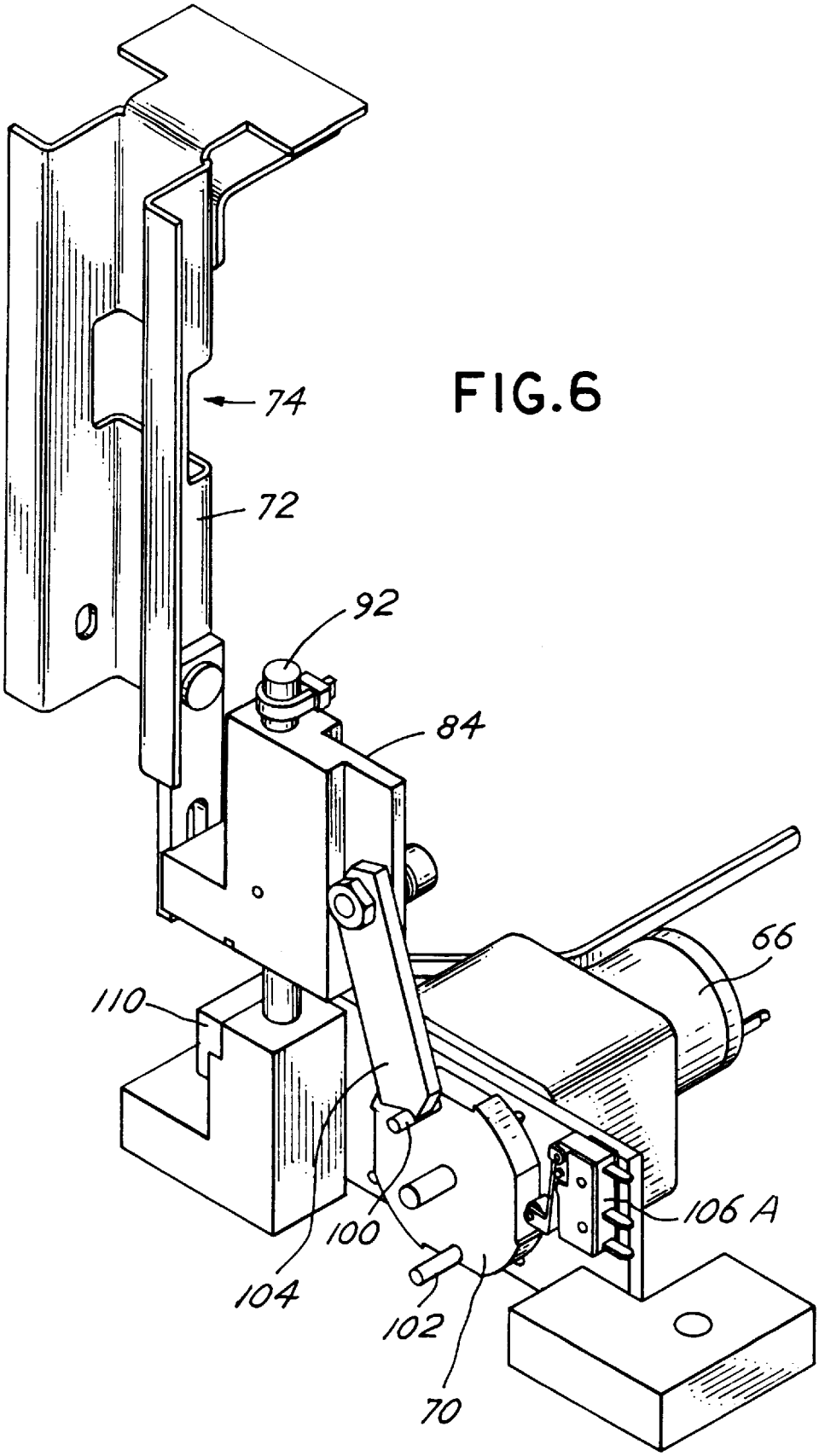
FIG. 6 is a perspective view of the lock system of FIG. 4 with the lock bar moved into an unlocked position by an electrically controlled actuating mechanism.

Turning briefly to FIG. 5, for locking purposes, each drawer 22 of the tool cabinet is provided with a latch member 76 for engaging the locking bar 72. The latch member 76 has a hook shape with a sloped leading edge 78 and a recess portion 80. When the drawer 22 is closed and the lock bar 72 is in its locking position as shown in FIG. 4, the upper edge 82 of the lock aperture 74 fits in the recess portion 80 of the latch member to prevent the drawer from being pulled out. When the lock bar is lifted into an unlocking position as shown in FIG. 6, the latch member 76 is clear of the locking aperture and the drawer can be pulled out.

Returning now to FIG. 4, The lower end of the lock bar 72 is rigidly connected to a carrier 84 by a link piece 89, which has a slot 90 to allow adjustment of the relative position between the lock bar and the carrier for accommodating manufacturing tolerances. The carrier 84 is slidably mounted on a guide shaft 92. A cable tie 94 placed on the guide shaft confines the upward travel of the carrier 84 during shipping and handling of the tool cabinet. The carrier 84 has an alignment hole 96 which allows the insertion of an alignment pin to engage a corresponding alignment hole on the guide shaft, thereby defining a proper unlocking position of the carrier. This feature is useful in setting up the connection between the carrier and the lock bar.

To move the lock bar 72 into locking and unlocking positions, the electronically controlled actuating mechanism includes the cam disc 70 which is mounted on an output shaft 98 of the gear reduction box. The cam disc 70 has two coupling pins 100 and 102 symmetrically disposed on opposite sides of the output shaft 98. The cam disk 70 can be rotated by the motor in a clockwise direction (as viewed in FIG. 4) into two locking positions in which the two coupling pins 100, 102 are in a generally horizontal alignment (FIG. 4) and two unlocking positions in which the two coupling pins are in a generally vertical alignment (FIG. 6).

The coupling between the cam disk 70 and the carrier 84 is provided by the engagement of one of the coupling pins 100 and 102 with a pawl 104 on the carrier. The pawl 104 is pivotally mounted on the carrier 84 such that it can be pivoted away from the carrier during engagement with the coupling pin 100, 102 to accommodate the non-linear movement of the coupling pin 100, 102. A helical spring 106 biases the pall 104 towards the carrier 84 so that the pall upon disengagement from the coupling pin 100, 102 is returned to a vertical position along the side of the carrier.

The operational status of the electronically controlled lock system is monitored by the microprocessor by sensing the rotational position of the cam disk 70 and the up/down position of the carrier 84. In the illustrated embodiment, the position of the cam disk 70 is monitored with a roller micro-switch 106A which engages the peripheral cam surfaces 108 of the cam disk 70. When the coupling pins 100 and 102 are in the horizontal (locking) position, the switch 106A is open. When the coupling pins are in the vertical (unlocking position), the switch 106A is closed by the engagement of the roller with a cam surface 108. The open/closed state of the switch 106A is sensed by the microprocessor to determine the rotational position of the cam disk. It will be appreciated that other types of sensing devices or sensing arrangement can also be used for this purpose.

The up/down position of the lock bar 72 is detected by a magnetic reed switch 110 which indicates whether the lock bar 72 is in the lower (locking) position or the higher (unlocking) position. The signal from magnetic reed switch 110 also can be used to provide an estimate of the distance by which the lock bar 72 is lifted. This information allows the microprocessor to determine whether the lock bar 72 has been put in an intermediate position between the locking and unlocking positions, which may occur if the upper edge of a locking aperture 74 engages the sloped leading edge of the latch member 76 on the corresponding drawer. The positional signals for the cam disk 70 and the carrier 84 are used by the microprocessor to determine the status of the lock system to control the proper operation of the electronically controlled actuating mechanism.

FIG. 6 shows the locking mechanism moved into an unlocking position by the motor-driven cam disk 70. In this position, the cam disk 70 has been rotated into a position where the coupling pins 100 and 102 are in a generally vertical position. The engagement between the upper coupling pin 100 with the end surface of the pall 104 causes the carrier 84 to be lifted up, and therewith the lock bar 72, into the unlocking position.

Figure 7:
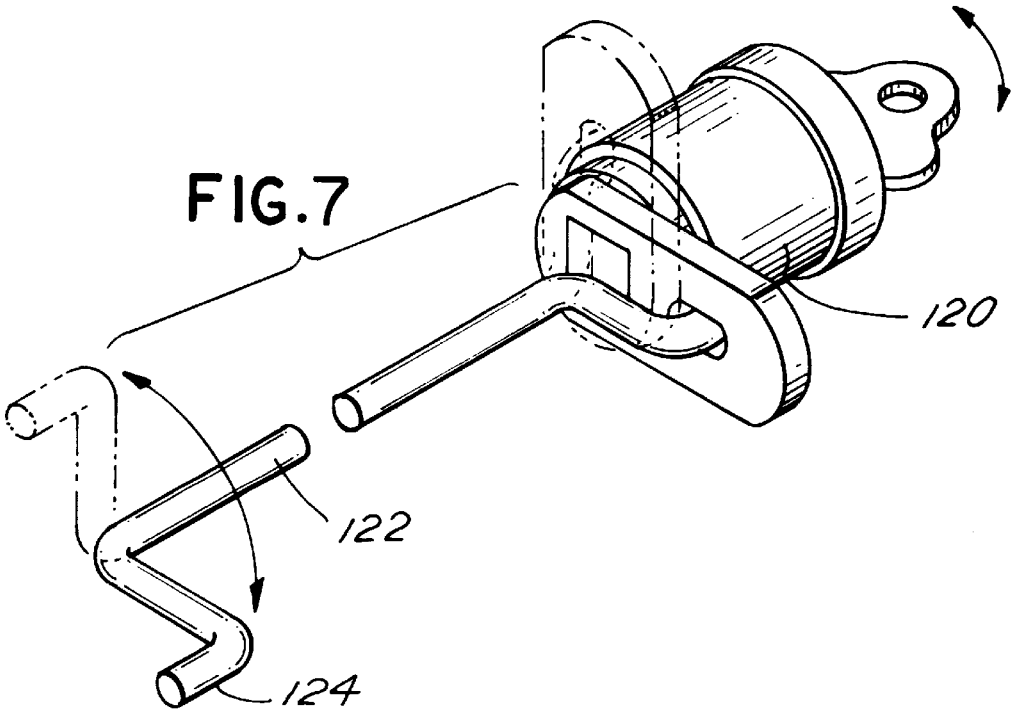
FIG. 7 is a perspective view of a key-operated lock with an actuating rod connected thereto.

In accordance with a feature of the invention, the electronically controlled actuating mechanism is effectively integrated with the conventional key-operated locking mechanism such that the interaction between the two mechanisms is largely transparent to the user. Moreover, the electronically controlled actuating mechanism can be overridden by the manual key-turning operation. As shown in FIG. 7, the manually operated lock 120 has an actuating rod 122 connected thereto. The actuating rod 122 has an L-shaped end portion 124 for cooperation with a T-shaped top flange 126 (FIG. 4) of the lock bar 72 for lifting the lock bar. In the preferred embodiment, the actuating rod 122 is rotatable by the turning of a key between a 3 o'clock position (the locking position) and an 11 o'clock position (the unlocking position). As can be best seen in FIG. 8, when the actuating rod 122 is turned into the unlocking position, the lock bar 72 is lifted due to the engagement of the L-shaped end 124 of the actuating rod 122 and the T-shaped flange 126 of the lock bar.

Returning now to FIG. 4, it can be seen that due to the slidable mounting of the carrier 84 on the guide shaft 92 and the detachable coupling between the pawl 104 and the coupling pin 100, the lock bar 72 can be lifted by the actuating rod 122 into its unlocking position even if the cam disk 70 is in a locking position as shown in FIG. 4. Thus, leaving the electronically controlled actuating mechanism in the locking position does not prevent the user from unlocking the tool cabinet by using a conventional key.

Figure 8:
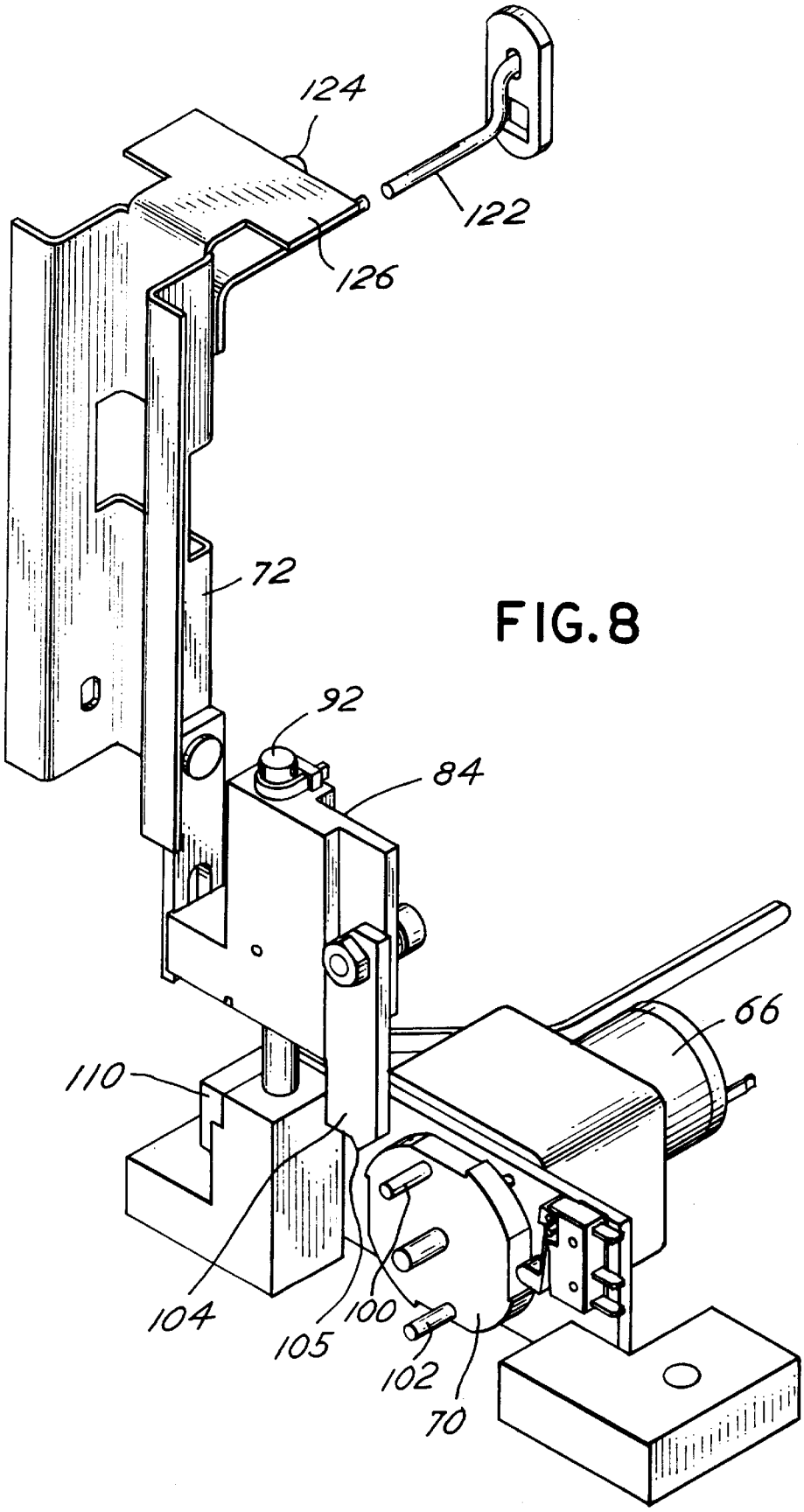
FIG. 8 is a perspective view similar to FIG. 6 but with the locking mechanism manually operated to override the electronically controlled actuating mechanism.

Similarly, the tool cabinet can be locked with a key even when the electronically controlled actuating mechanism is in the unlocking state as shown in FIG. 6. Referring to FIG. 8, the L-shaped end portion 124 of the actuating rod 122 is dimensioned such that when the actuating rod is rotated to the 12 o'clock position, the lock bar 72 is lifted sufficiently high to allow the tip 105 of the pawl 104 to disengage from the coupling pin 100 and be returned to its vertical position by the spring loading.

To close the tool cabinet with a key when it has been unlocked under electronic control as shown in FIG. 6, the user rotates the actuating rod 122 past the 12 o'clock position to lift the lock bar 72 to disengage, the pawl 104 from the coupling pin 100, and then rotates the actuating rod 122 to its 3 o'clock position to lower the lock bar 72 to its locking position. By monitoring the positions of the cam disk 70 and the carrier 84, the microprocessor 50 (FIG. 2) is capable of determining that the cam disk position is out of sync with the carrier position. If the user operates the remote to open the tool cabinet, the microprocessor rotates the cam disk by half a turn instead of the regular quarter turn to resume proper operation of the actuating mechanism.

Figure 9:
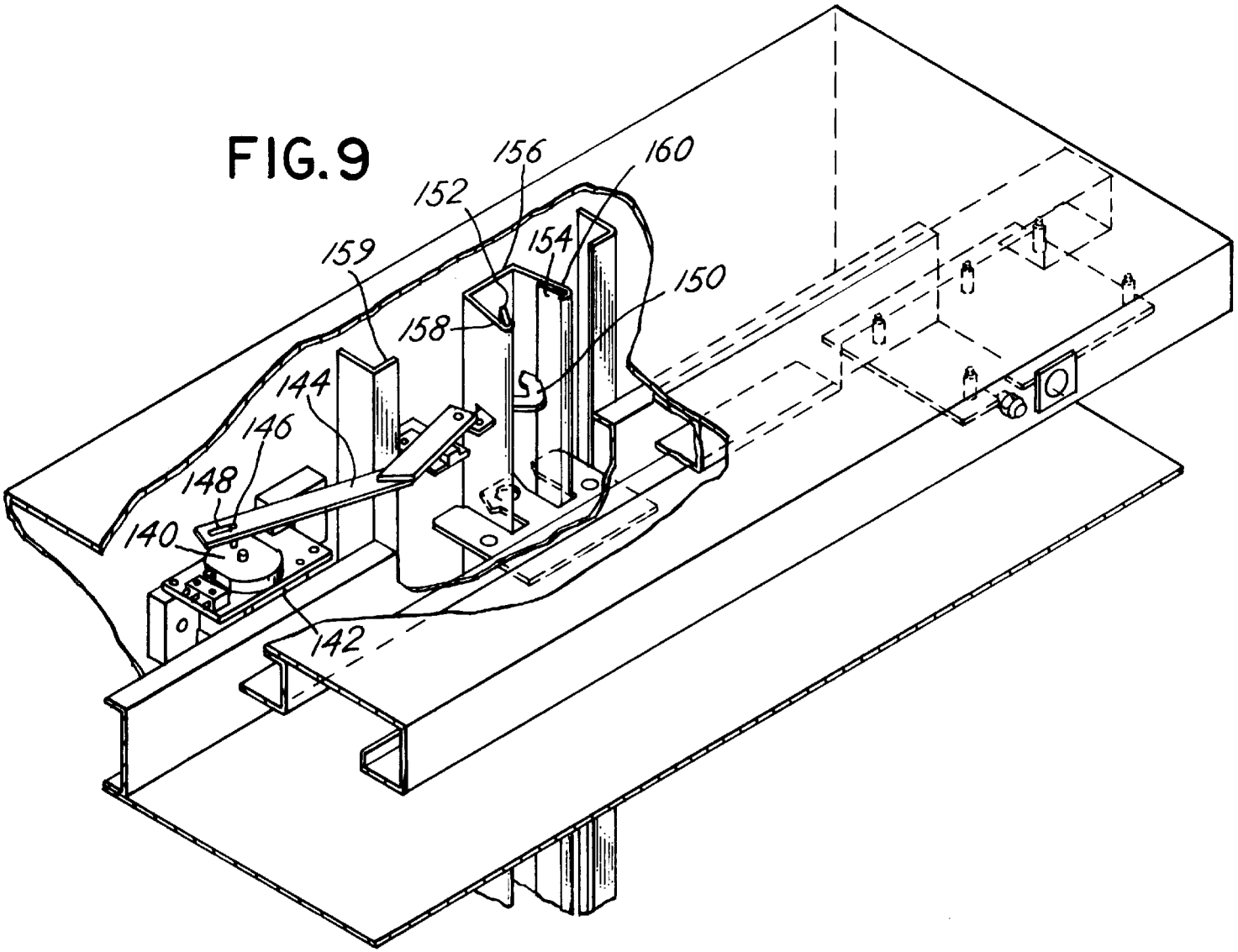
FIG. 9 is a perspective view of a second embodiment of the lock system.

The effective integration of the manual and electronic locking mechanisms according to the invention can also be implemented in other types of locking configuration. By way of example, FIG. 9 shows an embodiment in which the locking mechanism is actuated by actions in the horizontal direction. To more clearly illustrate the locking mechanism, only an outline of the tool cabinet is shown in dashed lines. As in the previous embodiment, the locking operation is controlled by a microprocessor on a control board. The electronically controlled actuating mechanism includes a cam disk 140 driven by a motor and gear box assembly 142.

The cam disk 140 is coupled to a link arm 144 via a coupling pin 146 mounted on the cam disk and fitted in a slot 148 in a proximal end of the link arm 144. The other end of the link arm 144 is pivotally connected to an actuating member 150 which is used to move two locking bars 152 and 154 into locking and unlocking positions. The link arm 144 is bent to avoid interference with an angled bar 159 which is used to enhance the structural strength of the tool cabinet.

The lock bars 152 and 154 are received in a guide rail 156 which has a generally U-shaped cross section with the edges of the side walls curved inwardly to form two channels 158 and 160. Each lock bar has a front edge received in a corresponding channel of the guide rail, and a rear edge received in a corresponding notch 162 or 164 (FIG. 10) in the actuating member 150. Depending on the position of the actuating member 150, the lock bars 152 and 154 are pivoted about their front edges into a locking position (best seen in FIG. 11A), or an unlocking position (be best seen in FIG. 11C).

Figure 10:
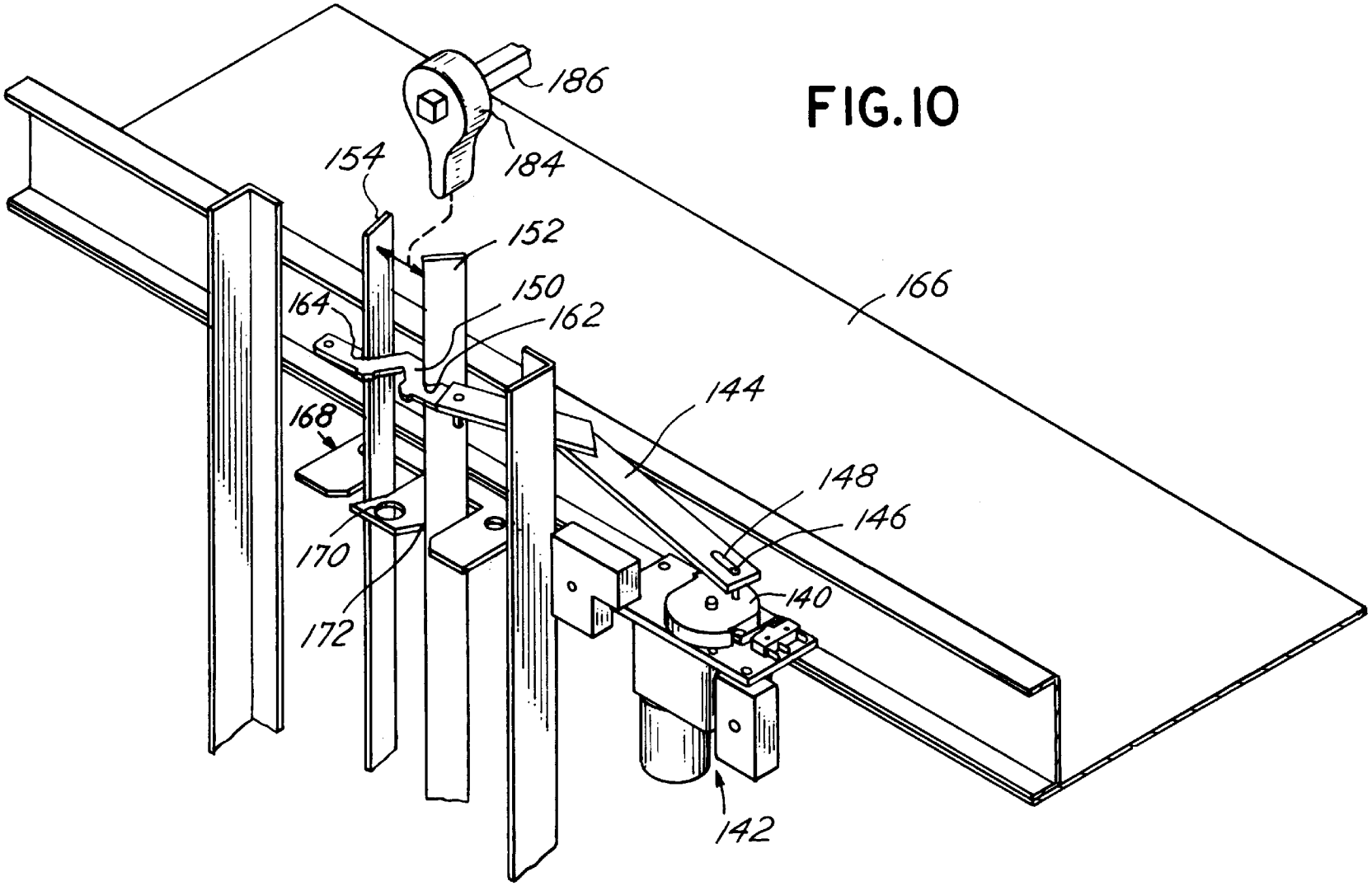
FIG. 10 is a perspective view of a tool drawer locked by the lock system of FIG. 9.

FIG. 10 shows a drawer 166 of the tool cabinet which has a latch member 168 for interacting with the lock bars for locking and unlocking. The latch member 168 is structured to have three prongs. When the drawer is closed, the center prong 170 of the latch member is inserted between the two lock bars. For purposes of illustration, the guide rail 156 (FIG. 9) is removed in FIG. 10 to more clearly show the coupling between the latch member and the lock bars. When the lock bars 152 and 154 are in the locking position as shown in FIG. 10, the rear edge of the lock bar 152 engages a catch 172 on the center prong 170 to prevent the drawer from being pulled out.

Figure 11A:
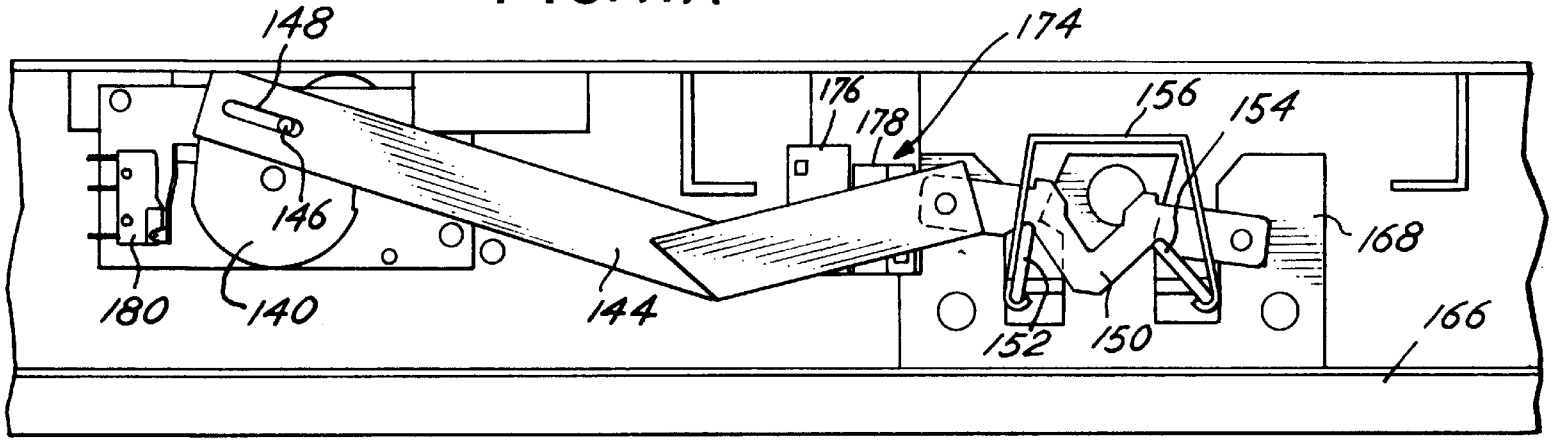
FIGS. 11A–D are top views of the lock system of FIG. 9 with an electronically controlled actuating mechanism in different operational positions.
Figure 11B:
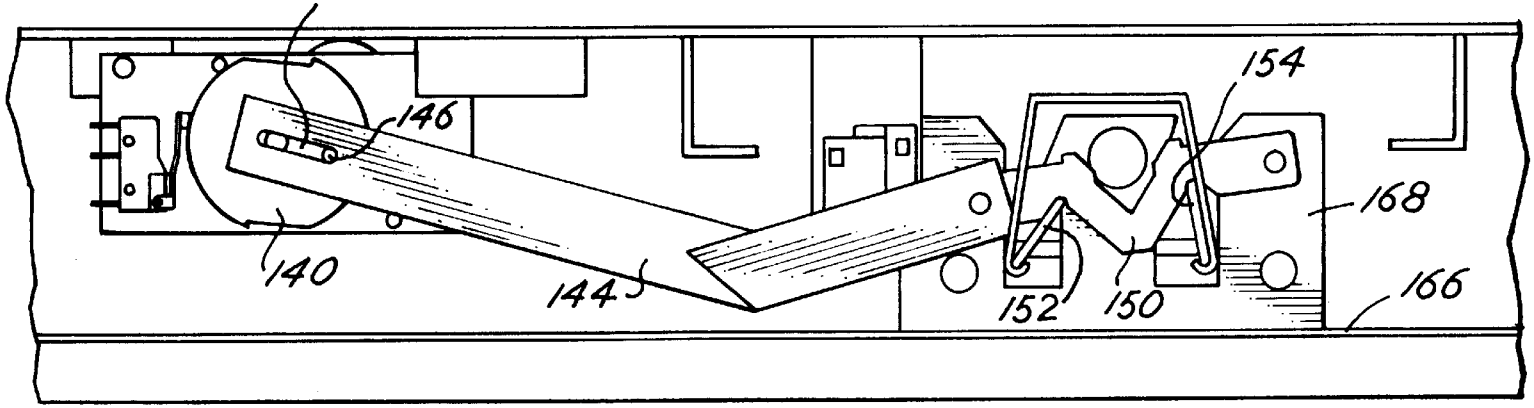
Figure 11C:
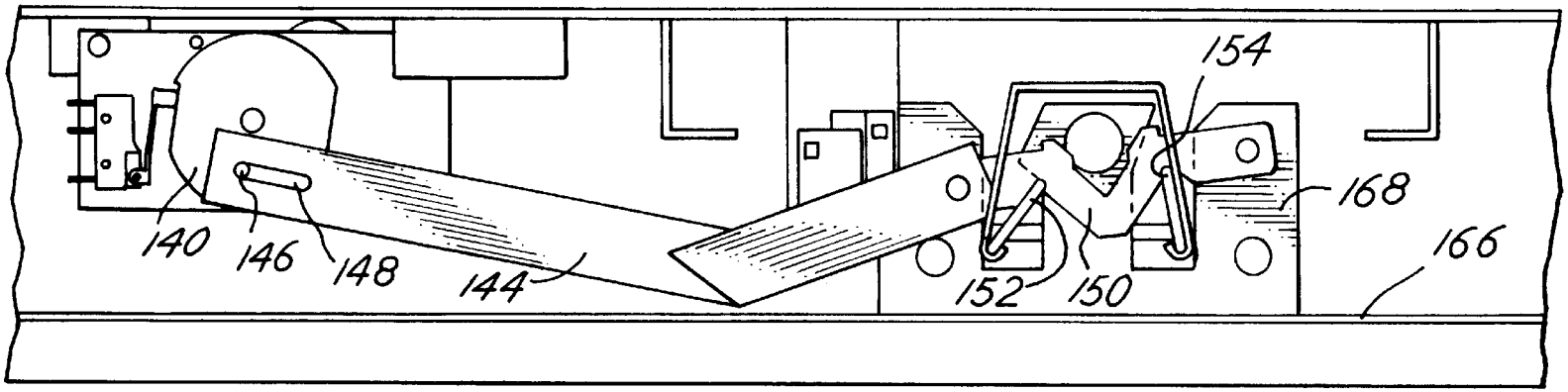
Figure 11D:
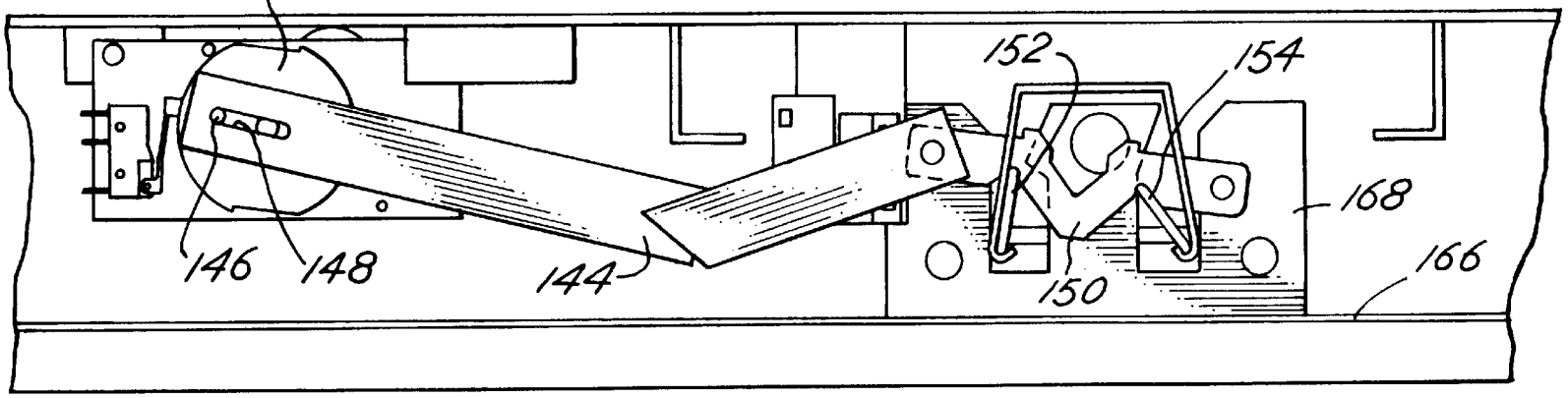

Turning now to FIGS. 11A–D, the positions of the lock bars 152 and 154 are monitored by a magnetic reed switch 174 which includes a permanent magnet 176 mounted on the link arm 144 and a switch body 178 fixed on the back wall of the tool cabinet. When the lock arms 152 and 154 are in the unlocking position shown in FIG. 11A, the magnet 176 on the link arm has little or no overlap with the switch body 178. In contrast, when the lock arms 152 and 154 are in the locked position as shown in FIG. 11C, the overlap between the magnet 176 and the switch body 178 is significant. The degree of overlap between the magnet and the switch body, which is reflected in the signal of the magnet reed switch, thus provides an indication of the positions of the lock bars. The rotational position of the cam disk 140 is detected with a roller micro-switch 180. The positional signals for the cam disk 140 and the lock bars 152 and 154 are processed by the microprocessor to control the proper operation of the locking mechanism as explained above in connection with the embodiment of FIG. 8.

The operation of the electronically controlled locking mechanism will now be described referring to FIGS. 11A–D. FIG. 11A shows the lock system in an unlocked position in which the coupling pin 146 on cam disk is at or close to a 12 o'clock position and engages or is adjacent to the distal end of the slot 148 in the link arm 144. When the microprocessor receives a control signal to lock the cabinet, it powers the motor to rotate the cam disk 140 by half a turn (180 degrees) to cause the coupling pin 146 to travel from the 12 o'clock position to the 6 o'clock position of FIG. 11C. When the coupling pin 146 is moved from the 12 o'clock position to the 3 o'clock position shown in FIG. 11B, it pushes the link arm 144 towards the guide rail 156 to horizontally move the actuating member 150, which in turn moves the lock bars 152 and 154 into their locking positions. When the coupling pin is 146 moved from the 3 o'clock position to the 6 o'clock position, it slides in the slot 148 of the link arm 144 and thus does not pull the link arm back. The length of the slot 148 is selected so that the coupling pin 146 in the 6 o'clock position engages or is adjacent to the proximal end of the slot.

When a control signal to unlock the cabinet is received, the microprocessor powers the motor to rotate the cam disk by another half a turn to move the coupling pin 146 from the 6 o'clock position to the 12 o'clock position of FIG. 11A. On its way from the 6 o'clock position to the 9 o'clock position shown in FIG. 11D, the coupling pin 146 pulls the link arm 144 away from the guide rail 156 to cause the actuating member 150 to move the lock bars 152 and 154 into the unlocking position. On its way from the 9 o'clock position to the 12 o'clock position, the coupling pin 146 slides in the slot 148 towards the distal end thereof so that the lock bars remain in the unlocking position.

Returning to FIGS. 9 and 10, like the embodiment of FIG. 4, the present embodiment also allows the manual key operation to override the electronically controlled actuating mechanism. As shown in FIG. 9, an actuating cam 184 is connected by an extension rod 186 to the lock and can be rotated by the turning of a key. The actuating cam 184 acts on the rear edges of the lock bars 152 and 154 to move them into the locking and unlocking positions. FIG. 10 shows the lock bars 152 and 154 in the locking position. To manually unlock the tool cabinet, the user turns the actuating cam 184 to push on the rear edge of the lock bar 152 to move both lock bars into the unlocking position. In this process the link arm 144 is pushed towards the cam disk 140. The slot 148 on the link arm allows the link arm to slide relative to the coupling pin. Similarly, when the cam disk 140 is in the unlocked position shown in FIG. 9, the user can lock the tool cabinet by turning the actuating cam 184 to act on the rear edge of the lock bar 154. The slot 148 on the link arm allows the link arm 144 to be pulled towards the guide rail 156 without being stopped by the coupling pin 146.

In view of the foregoing detailed description, it can be appreciated that the present invention provides an electronically controlled lock system for a tool cabinet or the like that effectively integrates the manual locking mechanism with the electronically controlled actuating mechanism. The lock system allows the user to manually override the electrically controlled actuating mechanism with the conventional key-turning operation. It will be appreciated that the application of the present invention is not limited to tool containers but can be implemented in many other types of containers with movable closures.

What is claimed is:

1. An electronic and manual actuating locking assembly for a multiple drawer cabinet of the type having a plurality of horizontally sliding drawers mounted vertically one above the other in a cabinet, the drawers including a latch member projecting from a side thereof, said cabinet including a latch bar movable generally vertically to engage or disengage from the drawer latch members; said locking assembly comprising, in combination:

a manually operable locking device, said locking device including an actuating rod movable between a locking and unlocking position, said latch bar including an engagement flange for engagement by the actuating rod to effect movement of the latch bar between engagement and disengagement of the latch bar with the drawer latch members;

a carrier attached to the latch bar and movable vertically therewith, said carrier including a pawl attached thereto, said pawl pivotally mounted on the carrier;

a rotatable cam disk mounted on the cabinet;

a motor for rotating the cam disk;

means for controlling the operation of the motor including a processor and at least one control signal input receiver to the processor for receipt of a remote control signal from a remote transmitter;

said cam disk including a pawl driving member for engaging the pawl upon rotation of the disk to translate the latch bar to an unlocked position; and said latch bar being movable by the actuating rod to disengage the cam disk pawl driving member from the pawl causing the pawl to pivot on the carrier to permit independent movement of the latch bar to the locked position.

2. The assembly of claim 1 wherein the cam disk pawl driving member comprises a pin for engaging the pawl upon rotation of the cam disk, said pin rotatable between a position of engagement with the pawl during only a portion of the rotation of the disk whereby the pawl effects translation of the carrier and latch bar from the locked to the unlocked position.

3. The assembly of claim 1 wherein the means for controlling further includes a sensor for detecting the rotational position of the cam disk.

4. The assembly of claim 1 wherein the means for controlling further includes indicators for displaying the position of the latch bar in the locked or unlocked position.

5. The assembly of claim 1 wherein the pawl includes a spring to bias the pawl to disengage from the panel driving member when the pawl is translated by the carrier in response to actuation of the latch bar by the latch bar actuating rod.

6. In a combination, a multiple drawer cabinet having an electronically and manually operated drawer latch bar mounted in the cabinet, said latch bar operable independently for locking and unlocking the drawers by a manual operator and by an electronically controlled motor, said manual operator also operable to lock said cabinet drawer by effecting release of said latch bar from engagement by the electronically controlled motor, said latch bar including a first latch member operable by said electronically controlled motor and a second latch member operable by the manual operator, said first and second latch members projecting separately from the latch bar and each engageable by a separate drive member for moving the latch bar vertically upward from a locked to an unlocked position;

the drive member for the first latch member including a biased, pivotal pawl;

said electronically controlled motor including a rotatable disk driven by the motor, said disk having a pawl engaging member for engaging the pawl upon rotation of the disk to lift the latch bar to the unlocked position, said pawl engaging member rotatable with the disk to effect release from engagement with the pawl and consequent release of the latch bar from the unlocked position by the disk;

said drive member for the second latch member movable between the locked position for the latch bar and the unlocked position for the latch bar and further moveable to a vertically extended position of the latch bar to effect disengagement of and release of the pawl from the disk and allow the pawl to be biased pivotally out of an engagement position with the disk, whereby upon release of the drive member for the second latch member when in the vertically extended position, the latch bar is released from control of the electronically controlled motor.

7. The combination of claim 6 wherein the pawl engaging member of the disk comprises an axially projecting pin mounted on the disk radially spaced from the axis of rotation of the disk.

8. The combination of claim 6 wherein the disk includes a peripheral cam surface and further including a cam surface sensor for detecting the rotational position of the disk and thereby the position of the latch bar.

9. The combination of claim 6 wherein the first latch member of the latch bar includes a sensor for detecting the vertical position of the latch bar.

10. The combination of claim 6 wherein the manual mechanism includes a rod engageable with the second latch member and a key operated lock for movement of the rod, said lock mounted in the cabinet.

* * * * *